United States Patent [19]

Kumata et al.

[11] Patent Number: 4,821,746

[45] Date of Patent: Apr. 18, 1989

[54] BAR-LIKE ARTICLE SUPPLYING APPARATUS IN HOPPER

[75] Inventors: Katsuhiko Kumata; Isao Endo, both of Chiba; Taro Nishikimoto, Tokyo, all of Japan

[73] Assignees: Tokyo Automatic Machinery Works, Ltd.; Japan Tobacco, Inc., both of Tokyo, Japan

[21] Appl. No.: 29,997

[22] Filed: Mar. 25, 1987

[30] Foreign Application Priority Data

Mar. 31, 1986 [JP] Japan ..... 61-73166

[51] Int. Cl.[4] ..... A24C 5/32; A24C 5/33

[52] U.S. Cl. ..... 131/282; 221/167; 221/169

[58] Field of Search ..... 221/171, 172, 312 B, 221/311, 167, 169, 174; 131/283, 282, 94

[56] References Cited

U.S. PATENT DOCUMENTS 3,976,085 8/1976 Hall ..... 131/283

*Primary Examiner*—V. Millin

*Attorney, Agent, or Firm*—Watson, Cole, Grindle & Watson

[57] ABSTRACT

The present invention provides a bar-like article supplying apparatus in a hopper, and more specifically to an apparatus for supplying bar-like articles such as cigarettes or filter plugs to the hopper, wherein a bottom lid comprises a plurality of small bottom lids obtained by dividing the bottom lid in a radial direction of bar-like articles, whereby these small bottom lids are rotated in a radial direction of the bar-like articles to make the moving stroke of the bottom lid small to miniaturize the entire apparatus and bar-like articles are supplied preferentially from a depressed portion in the upper surface of the bar-like articles within the hopper, thus eliminating a disturbance of the bar-like articles.

8 Claims, 6 Drawing Sheets

BAR-LIKE ARTICLE SUPPLYING APPARATUS IN HOPPER

BACKGROUND OF THE INVENTION

1. Field of the Invention

This invention relates to an apparatus for supplying bar-like articles such as cigarettes, filter plugs, etc. to a hopper.

2. Description of the Prior Art

In the past, for example, in the case where filter plugs are supplied to a plurality of cigarette-producing machines, a plurality of plug-supplying apparatuses are provided below a hopper in which filter plugs are arranged in one direction and received in an accumulated fashion, and each of the plug-supplying apparatuses are connected to the cigarette-producing machines.

Filter plugs received within the hopper are received therein with upper surfaces thereof being flat. However, the quantity of filter plugs to be supplied by plug-supplying apparatus is different or varied in dependence upon the producing speed or operating rate of respective cigarette-producing machines, and therefore, the mode of reduction of filter plugs is not even so that the upper surfaces thereof become rugged surfaces.

Filter plugs supplied to the hopper are normally received into a generally rectangular parallelopiped box so that they are arranged in one direction and in an accumulated fashion, the filter plugs being supplied into the hopper by means of a supplying device constructed as described hereinafter.

The supplying device is composed of a mounting frame that is reversible up and down on which said box is mounted, and a bottom lid that may be opened and closed to close the bottom surface of the box. First, the box is mounted on the mounting frame with the bottom surface of the box directed upward, the bottom surface thereof is closed by the bottom lid after which the box is reversed to adjust the bottom surface to the upper surface of the hopper, and the bottom lid is pulled out and opened whereby filter plugs are supplied into the hopper.

However, the aforesaid bottom lid is composed of a single plate, and it is moved horizontally in a radial direction of the filter plugs and pulled out, and therefore the stroke thereof becomes extremely great and the entire apparatus becomes large-scaled.

Furthermore, since when the filter plugs are supplied, the upper surface of the filter plugs within the hopper are in the form of rugged surfaces due to the difference in falling speeds, a portion of the filter plugs falling from the box is rolled slantwise from a raised portion toward a depressed portion to cause a disturbance of attitude, thus posing inconvenience such that the filter plugs disturbed in attitude tend to be clogged failing to provide a smooth supply of bar-like articles.

SUMMARY OF THE INVENTION

The present invention overcomes the above-described drawbacks as noted above, and an object of the invention is to provide a supplying apparatus without involving a disturbance of attitude of bar-like articles, wherein a bottom lid is composed of a plurality of small bottom lids obtained by division thereof in a radial direction of bar-like articles in place of the conventional single bottom lid which is pulled out by movement thereof in a radial direction of the bar-like articles. These small bottom lids are radially rotated to thereby decrease the moving stroke of the bottom lid for miniaturization of the entire apparatus and a bar-like article present in the depressed portion of the upper surface of the bar-like articles within the hopper takes the precedence to be supplied.

According to a feature of the first invention of the present application, there is provided a bar-like article supplying apparatus in a hopper wherein a box filled with bar-like articles arranged in one direction and in an accumulated fashion is arranged on the hopper in a condition that the box is closed by a bottom lid. The bottom lid being divided in a radial direction of bar-like articles into a plurality of small bottom lids, and the small bottom lids being provided so that they may be rotated in a radial direction of bar-like articles. According to a feature of the second invention of the present application, there is provided a bar-like article-supplying apparatus wherein a box filled with bar-like articles arranged in one direction and in an accumulated fashion is arranged on the hopper in a condition that the box is closed by a bottom lid. The bottom lid being divided in a radial direction of bar-like articles into a plurality of small bottom lids. The small bottom lids being provided so that they may be rotated in a radial direction of bar-like articles, the upper end of each of the and small bottom lids fronting into said box, each of the small bottom lids being pivotally moved.

According to the supplying apparatus of the present invention, the plurality of small bottom lids obtained by division thereof in a radial direction of bar-like articles as in the first invention are respectively rotated in the radial direction of bar-like articles to supply bar-like articles per small bottom lid. Therefore, the moving stroke of the bottom lid becomes extremely small as compared with prior art in which the bottom lid in the form of a single plate is moved in a radial direction of bar-like articles and pulled out, thus enabling a miniaturization of the entire apparatus. A bar-like article present in the depressed portion of the upper surface of the bar-like article within the hopper may take the precedence to be supplied. The upper surfaces of bar-like articles within the hopper are maintained approximately flat, with the result that bar-like articles are not rolled slantwise from the raised portion toward the depressed portion to cause a disturbance of attitude and the bar-like articles disturbed in attitude are not clogged as was experienced in the prior art apparatus.

Furthermore, in addition to the aforementioned effect, the second invention further provides an arrangement wherein each of the bottom lids is pivotally moved to thereby make bar-like articles within the box even, and therefore, bar-like articles may be supplied very quickly and orderly from the box toward the hopper so that there is enough time to set the succeeding box and no delay in work occurs.

DETAILED DESCRIPTION OF THE PREFERRED EMBODIMENTS

Figure 1:
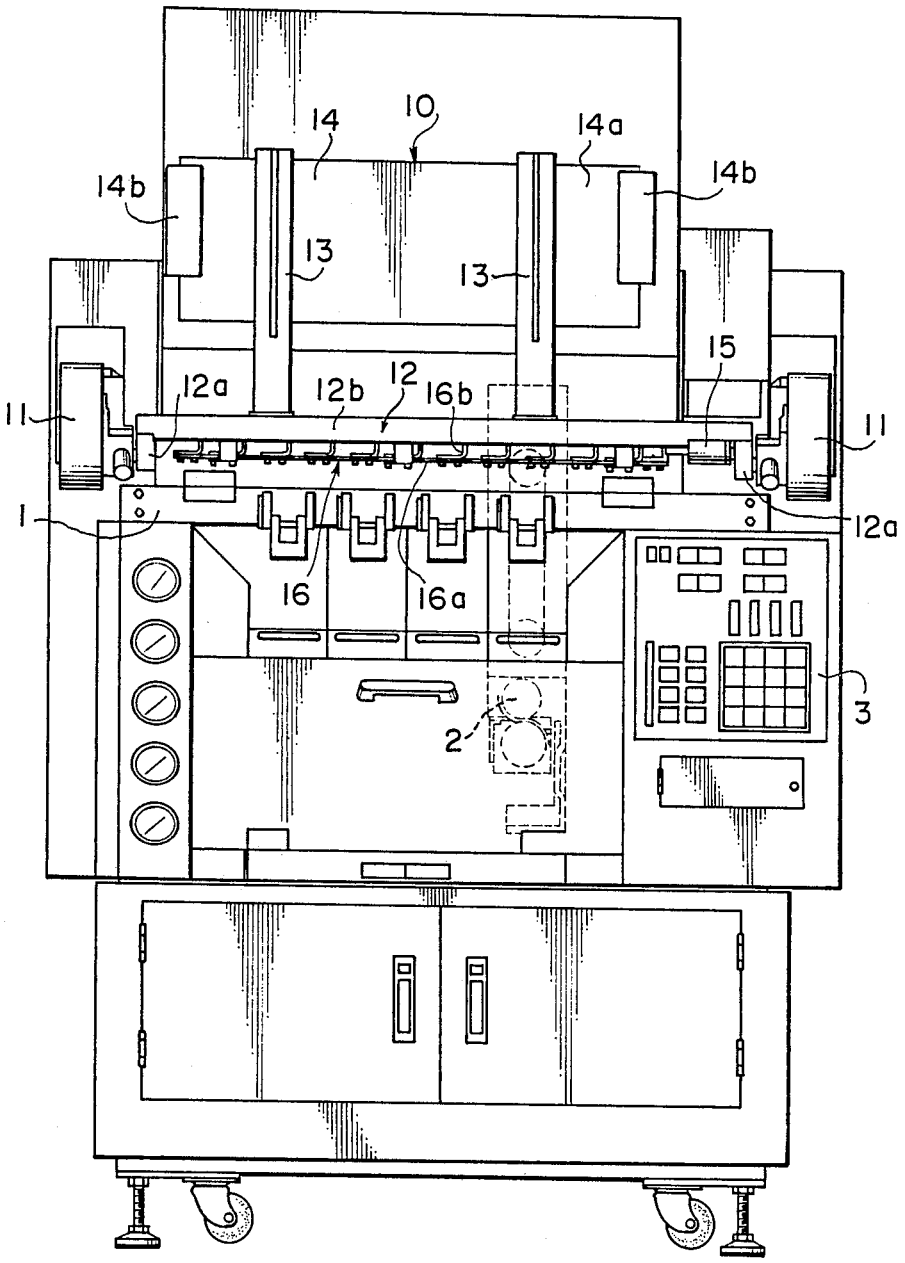
FIG. 1 is a front view of a bar-like article supplying apparatus in a hopper showing one embodiment of the present invention.

An embodiment of a first invention will now be described with reference to FIGS. 1 to 6. In FIG. 1, a hopper is indicated at 1, a supplying device at 2, a controller at 3 and a supplying device at 10.

Figure 3:
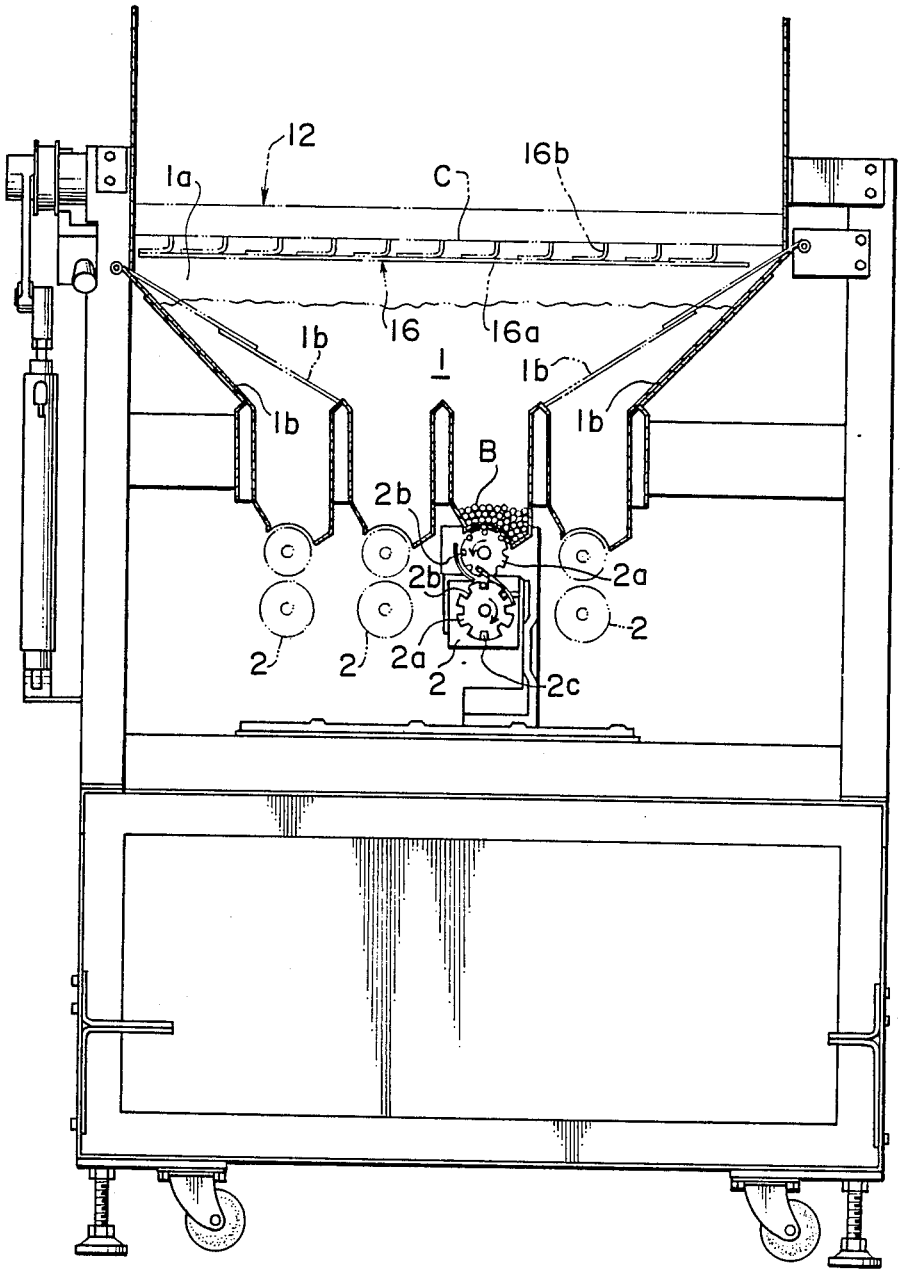
FIG. 3 is a longitudinal sectional view in an enlarged scale of FIG. 1.

The hopper 1 comprises, as shown in FIG. 3, two plates 1a disposed parallel to each other spaced apart approximately equal to the length of filter plugs B in a lateral direction, and bottom plates 1b in the form of an inverted V disposed therebelow, a plurality of supplying devices 2 being juxtaposed below the bottom plates 1b.

The bottom plate 1*b* consists of two small bottom plates which are superimposed, and where two supplying apparatuses 2 are used, the small bottom plates may be used while being narrowed as shown by the broken lines.

The supplying apparatus 2 consists, as shown in FIG. 3, of cylindrical bodies 2a in the form of a gear in section which are vertically aligned. The filter plugs B are engaged one by one with tooth-grooves 2*b* of the cylindrical bodies 2 so that the filter plugs are moved out one by one from a hole 2*c* provided below the supplying apparatus 2. Each of the supplying apparatuses are respectively connected to cigarette producing machines not shown.

Figure 2:
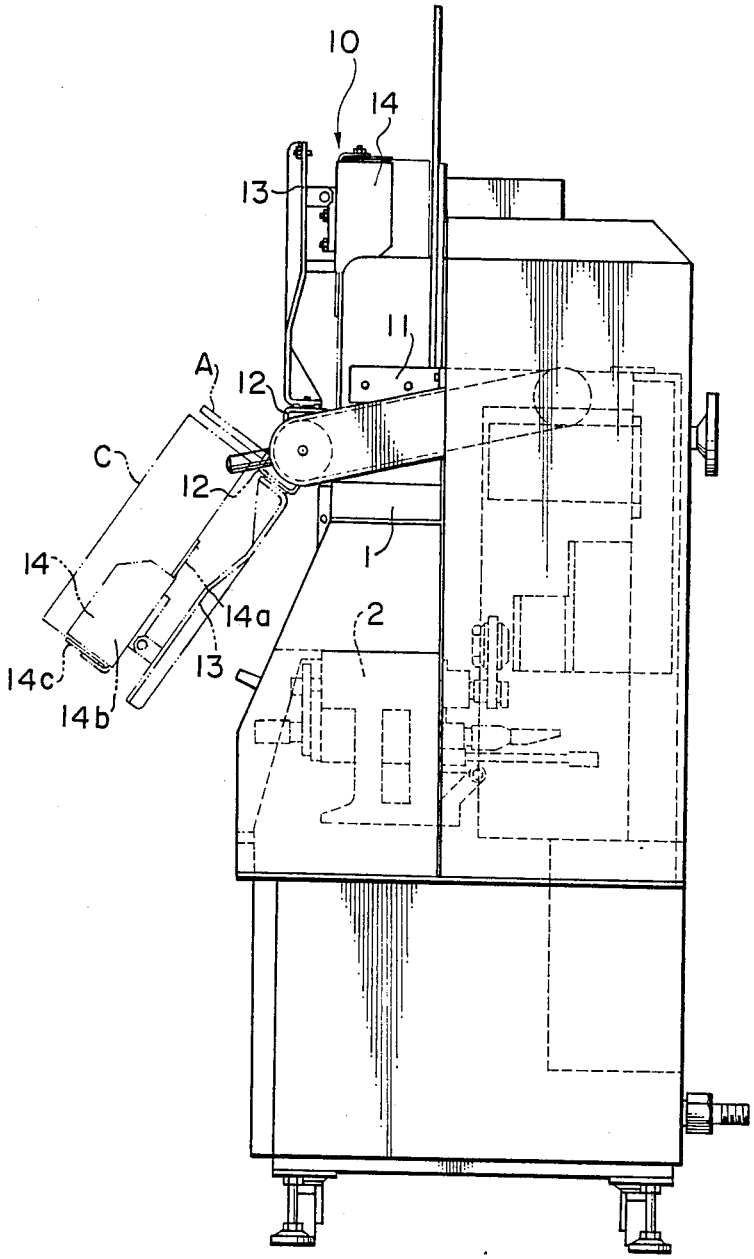
FIG. 2 is a side view of the same.

Pivotal arms 11 are respectively provided on the opposite sides of the hopper 1, as shown in FIGS. 1 and 2, so that the former may be pivotally moved up and down, and a supplying apparatus 10 is extended over the front end of the pivotal arms 11. The pivotal arms 11 are operated such that when the pivotal arms 11 are at their upper end, the supplying apparatus 10 assumes a position above the hopper 1, whereas when the pivotal arms are at their lower end, the supplying apparatus 10 assumes a position frontwardly of the hopper 1.

Figure 5:
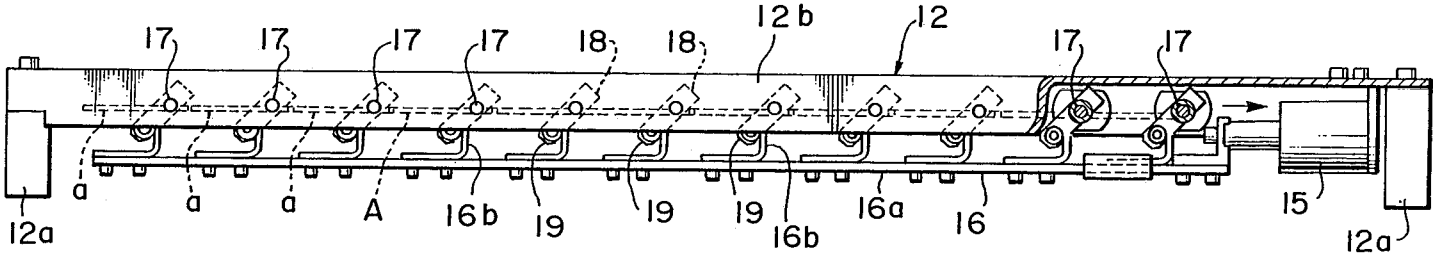
FIG. 5 is a front view showing a bottom lid in an enlarged scale.

The supplying apparatus 10 principally comprises a bottom plate 12, a bottom lid A, a mounting plate 13, a mounting plate 14, an air cylinder 15 and an anchor plate 16, as shown in FIGS. 2 and 5.

Figure 4:
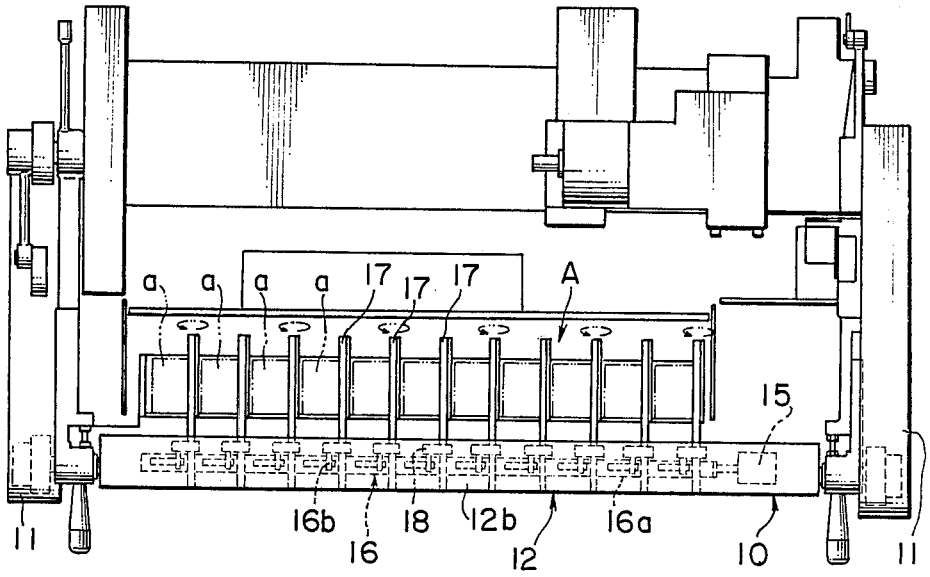
FIG. 4 is a cross-sectional plan view.

The bottom plate 12 is designed so that as shown in FIGS. 4 and 5, lengthy plates 12*b* in the form of a gate in section are extended over side plates 12a pivotably mounted on the pivotal arms 11. Rotational shafts 17 are juxtaposed at predetermined intervals on the lengthy plate 12*b* of the bottom plate 12, and one ends thereof are projected and small bottom lids a are provided to thereby constitute a bottom lid A.

Figure 6:
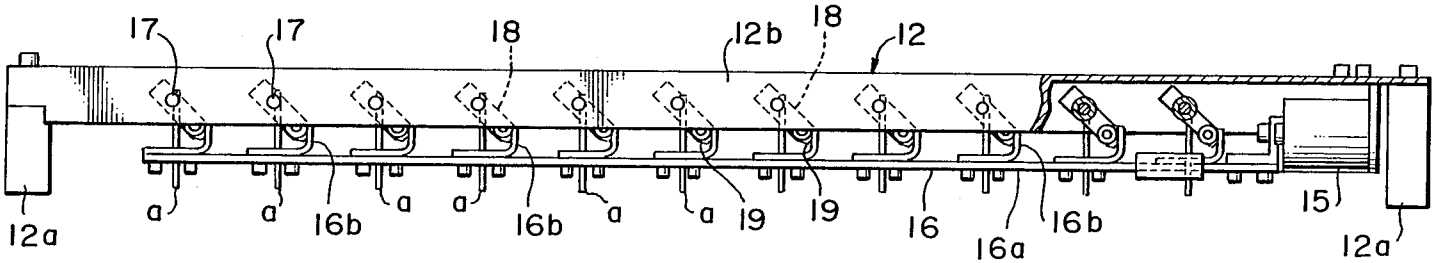
FIG. 6 is a view in an opened condition of FIG. 5.

Operating pieces 18 are projected in the same phase as the small bottom lids a on the rotational shafts 17, respectively, as shown in FIGS. 5 and 6, and engaging rollers 19 are provided on the ends of the operating pieces 18, respectively.

The engaging plate 16 comprises engaging pieces 16*b* provided parallel to each other at predetermined intervals on a horizontal plate 16a provided in parallel below the bottom plate 12, the horizontal plate 16a having one end connected to an air cylinder 15 provided on the end of the bottom plate 12.

The air cylinder 15 is designed so that at the time of OFF, it is extended and each engaging piece 16b urges each engaging roller 19 to engage to close each small bottom lid a (FIG. 5), and at the time of ON, it is withdrawn to disengage each engaging piece 16*b* from each engaging roller 19 and each small bottom lid a is opened by its own weight (FIG. 6).

A mounting plate 13 as shown in FIGS. 1 and 2 is stood upright on the bottom plate 12, and a mounting frame 14 is extended over the mounting plate 13.

The mounting frame 14 is composed of a front plate portion 14*a*, a side plate portion 14*b* and an upper plate portion 14*c* so that a box C filled with filter plugs is charged in a condition as indicated by the broken lines in FIG. 2 and maintained so as to be reversed into a state as indicated by the solid lines.

The first invention operates as follows: First, reduction of filter plugs B within the hopper 1 to such an extent that need be replenished is detected by means of a detector or visually. Subsequently, the box C is filled in a state indicated by the broken lines in FIG. 2 and reversed as indicated by the solid lines. At that time, the air cylinder 15 is in the OFF condition as shown in FIG. 5, and the bottom lid A is opened. Then, the level of the box C is adjusted to the upper surface of the filter plugs B within the hopper 1, and the air cylinder 15 is turned ON. In the case where the filter plugs B are absent below each of the small bottom lids a, the small bottom lids a are opened and the filter plugs B are preferentially supplied to the depressed portions. In the case of the raised portion where the filter plugs are present directly below the small bottom lids a, the small bottom lids are not opened and a supply of the filter plugs B will be made later.

While in the above-described embodiment, it is designed so that each of the small bottom lids a is opened by its own weight, it is to be noted that if a torsional coil spring is provided on each of the small bottom lids a, the lid may be urged in advance in a direction of opening it.

Figure 7:
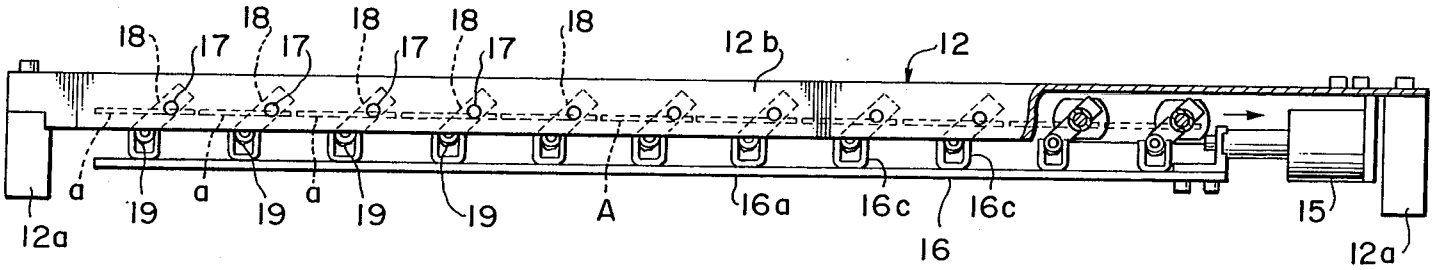
FIG. 7 is a front view showing a bottom lid of the second invention.

Next, the second invention will be described with reference to FIGS. 7 and 8. In the second invention, U-shaped engaging pieces 16c are provided in place of the inverted L-shaped engaging pieces 16*b* in the first invention, and each of the small bottom lids a is in the form of a projection so that when the former is opened as shown in FIG. 8, its upper end a′ may front into the box C.

Figure 8:
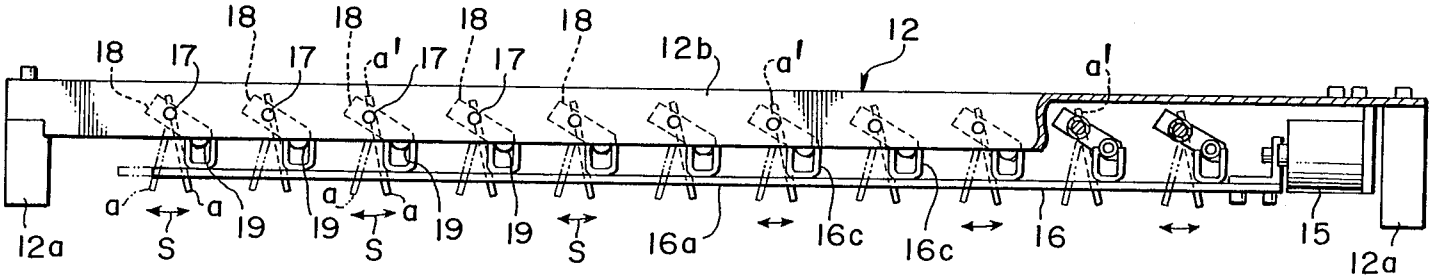
FIG. 8 is a view showing a pivotal state of FIG. 7.

In addition, in the second invention, the controller 3 periodically turns on and off the air cylinder 15 during the time the small bottom lids are opened, and the lids a may be pivotally moved with stroke of S in FIG. 8. Other mechanical structures of the second invention are substantially the same as those of the first invention, and explanation thereof will be omitted.

With the aforementioned arrangement, in the second invention, when the filter plugs B are supplied to open the small bottom lids a, the air cylinder 15 is periodically turned on and off by the controller 3 and the small bottom lids a are pivotally moved with the stroke S.

Since the upper surface of the filter plugs B within the hopper 1 is partitioned by the small bottom lids a, the filter plugs B are preferentially supplied from the depressed portion. The portion where the filter plugs B are preferentially supplied within the box C corresponds to the depressed portion, but the small bottom lids a are pivotally moved whereby the filter plugs B within the box C are forcibly balanced and the upper surface of the filter plugs B becomes flat.

Namely, periodical turning on and off of the air cylinder 15 causes pivotal movement of the small bottom lids a to vibrate the filter plugs B. With this, the filter plugs B are never rolled to be slanted within the box C, and a very smooth supply of plugs from the box C to the hopper 1 is carried out.

What is claimed is:

1. Apparatus for supplying bar-like articles to a hopper, comprising:

a receptacle pivotally mounted to said hopper for receiving bar-like articles from a source of supply in a first position and for dispensing said bar-like articles in a second position;

said receptacle including a plurality of bottom lid elements movable between respective open and closed positions respectively corresponding to said second and first positions of said receptacle; and means for moving said plurality of bottom lid elements and including a like plurality of rotatable shafts each connected to a respective bottom lid element and means for rotating said rotatable shafts to move said bottom lid elements to said open position.

2. Apparatus according to claim 1, further comprising frame means for pivotally mounting said receptacle to said hopper and including a pair of arms each being pivotally mounted on each side of said hopper, a frame supported between said pair of pivotal arms and carrying said receptacle, said pair of pivotal arms being lowered to bring said receptacle into said first position and said pivotal arms being raised to bring said receptacle in said second position above said hopper.

3. Apparatus according to claim 2, wherein said means for moving further includes a movable plate element engaging said plurality of movable lid elements and movement of said plate element in one direction causes said plurality of lid elements to open and movement of said plate element in the opposite direction causes said plurality of lid elements to be closed.

4. Apparatus according to claim 3, wherein said moving means further includes a air cylinder connected to said plate element for movement in either of the two directions.

5. Apparatus for supplying bar-like articles to a hopper, comprising:

a receptacle pivotally mounted to said hopper for receiving bar-like articles from a source of supply in a first position and for dispensing said bar-like articles in a second position;

said receptacle including a plurality of bottom lid elements movable between respective open end closed positions respectively corresponding to said second and first positions of said receptacle; and means for moving said plurality of bottom lid elements and including a like plurality of rotatable shafts each connected to a respective bottom lid element and means for rotating said rotatable shafts to move said bottom lid elements to said open position, and said means for moving being adapted to oscillate, thereby causing said bottom lid elements to alternately open and close repetitively.

6. Apparatus according to claim 5, further comprising frame means for pivotally mounting said receptacle to said hopper and including a pair of arms each arm being pivotally mounted on each side of said hopper, a frame supported between said pair of pivotal arms and carrying said receptacle, said pair of pivotal arms being lowered to bring said receptacle into said first position and said pivotal arms being raised to bring said receptacle into said second position above said hopper.

7. Apparatus according to claim 6, wherein said means for moving further includes a movable plate element engaging said plurality of movable lid elements and movement of said plate element in one direction causes said plurality of lid elements to open and movement of said plate element in the opposite direction causes said plurality of lid elements to be closed.

8. Apparatus according to claim 7, wherein said means for moving further includes an air cylinder connected to said plate element.

* * * * *